United States Patent [19]

DeMoss

[11] 4,008,760

[45] Feb. 22, 1977

[54] CIRCULATING VALVE

[75] Inventor: Edward E. DeMoss, Garland, Tex.

[73] Assignee: Teledyne, Inc., Garland, Tex.

[22] Filed: Feb. 25, 1976

[21] Appl. No.: 661,250

[52] U.S. Cl. ..... 166/321; 137/68 R

[51] Int. Cl.[2] ..... F04F 1/08; E21B 43/12

[58] Field of Search ..... 166/224 R; 137/68 R, 137/71

[56] References Cited

UNITED STATES PATENTS

| | | | |
|---|---|---|---|
| 2,128,253 | 8/1938 | Johnson | 137/68 R |
| 2,919,709 | 1/1960 | Schwegman | 137/68 R |
| 3,282,348 | 11/1966 | Artigue | 166/224 |
| 3,807,428 | 4/1974 | Watkins et al. | 137/71 |

*Primary Examiner*—James A. Leppink
*Attorney, Agent, or Firm*—Vinson Elkins Searls Connally & Smith

[57] ABSTRACT

Disclosed is a circulating valve for use in a well. The circulating valve includes at least one valve plug initially blocking flow through the valve which moves to a retained position permitting flow through the valve upon the application of a predetermined pressure differential across the valve plug. This abstract is neither intended to define the scope of the invention, which, of course, is measured by the claims, nor is it intended to be limited in any way.

20 Claims, 7 Drawing Figures

CIRCULATING VALVE

BACKGROUND OF THE INVENTION

1. Field of the Invention

This invention relates to a circulating valve for use in a well. Circulating valves are used to permit flow between two well conduits.

2. The Prior Art

In the completion or production of a well, a circulating valve is often installed to permit a high volume rate of flow between two of the well conduits. For example, it may be desired to kill a producing well to perform anyone of several operations. A circulating valve controlling flow between the tubing string bore and the annulus around the tubing string would be opened. Fluid would then be circulated through the circulating valve to kill the well.

Generally circulating valves have been activated by the use of wireline tools extending from the surface down into the well. For a deep well, use of wireline tools is expensive, poses a hazard of possible loss of tools in the well, requires time to run the tools into the well, and requires manipulation from the surface to affect opening of the valve.

Some circulating valves are pressure operated. U.S. Pat. No. 3,282,348 to Artigue discloses a pressure operated circulating valve which permits uni-directional flow through the valve and which moves to a closed position preventing any flow through the valve upon the application of a predetermined pressure differential across the valve. U.S. Pat. No. 3,807,428 to Watkins, et al discloses a circulating valve which is opened upon the application of a predetermined first absolute pressure and which is closed upon the application of a predetermined second higher absolute pressure.

Neither of circulating valves disclosed in the above patents permit any condition of flow through the valve once the valve is opened. The rate of flow through the circulating valves disclosed in the above patents is limited because only one flow path through the valve exists. In addition, the circulating valve disclosed in Watkins, et al would be uncontrollable in the event tubing pressure could not be controlled from the surface.

This invention is an improvement over the circulating valve disclosed in a copending application of William A. Dudley entitled "CIRCULATING VALVE" Ser. No. 661,249 filed Feb. 25, 1976 and also assigned to the assignee of this application.

OBJECTS OF THE INVENTION

An object of this invention is to provide a circulating valve for use in a well which upon opening retains an upper valve plug in a position permitting any condition of flow through the valve.

Another object of this invention is to provide a circulating valve for use in a well wherein an upper valve plug is retained in a position out of the flow path after the valve is opened.

Another object of this invention is to increase the rate of flow through a circulating valve by having two flow paths through the valve.

Another object of this invention is to provide a circulating valve with an increased flow rate having two flow paths wherein an upper valve plug is retained in a position permitting any condition of flow through the valve once the valve is opened.

Another object of this invention is to provide a circulating valve for use in a well wherein a circumferential seal around an upper valve plug body performs the dual functions of sealing between the plug body and a seal bore to prevent flow through the valve and of retaining the plug body in a pocket to permit flow through the valve.

Another object of this invention is to provide a circulating valve for use in a well with an increased flow rate wherein an upper valve plug is retained out of the flow path through the valve and a lower valve plug is caught in a pocket out of the flow path once the valve is opened.

These and other objects, and features of advantage of this invention, will be apparent, from the drawings, detailed description, and the appended claims.

BRIEF DESCRIPTION OF THE DRAWINGS

In the drawings wherein like numerals indicate like parts and wherein two embodiments of this invention are shown.

DESCRIPTION OF THE PREFERRED EMBODIMENTS

In a well, circulating valves provide a means for obtaining a high volume rate of flow between well conduits. The circulating valve of this invention is normally closed but opens upon a predetermined pressure differential across the valve and then remains open to any condition of flow through the valve. An increased rate of flow through the circulating valve of this invention is possible because the flow passage through the valve provides two flow paths.

Figure 1:
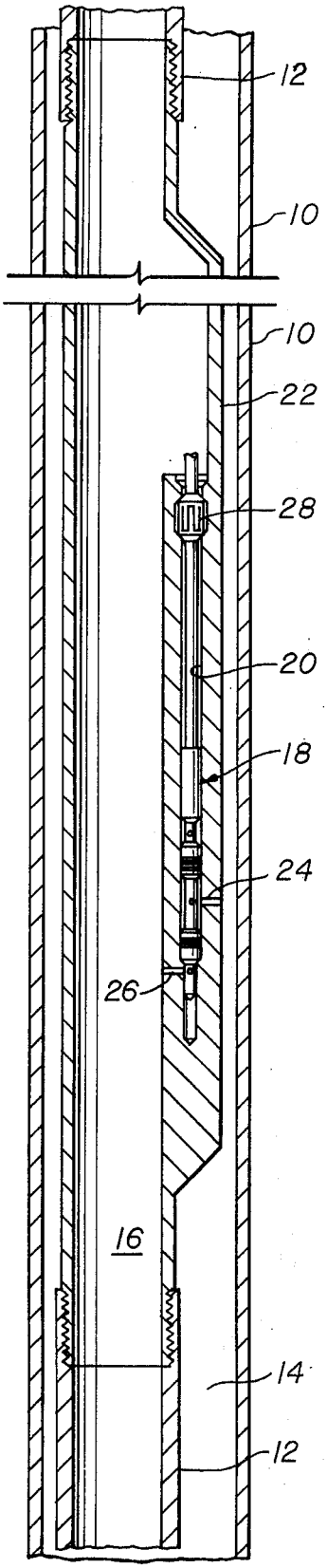
FIG. 1 schematically illustrates, in partial cross section, a circulating valve positioned in a well.

In FIG. 1 a portion of a well for the production of fluids is shown. Into the well extend one or more casing string 10 to line the well wall. Through the casing string 10 extends a production tubing string 12 through which well fluids may be produced. To control flow between the annulus 14 around the tubing string 12 and the bore 16 of the tubing string 12, a circulating valve, generally indicated at 18, is positioned in the well.

The circulating valve 18 of this invention is adapted to be positioned within the side pocket receptacle 20 of a side pocket mandrel 22 within the production string 12, although other arrangements could be made for positioning the circulating valve 18 in the well. The side pocket mandrel may be conventional and includes a first port 24 communicating between the annulus 14 and the side pocket receptacle 20 and a second port 26 communicating between the bore 16 and the side pocket receptacle 20.

The circulating valve may be held in place within the side pocket receptacle 20 by a latch mechanism 28 capable of maintaining the circulating valve 18 within the side pocket receptacle 20 under an appreciable pressure differential.

Figure 2:
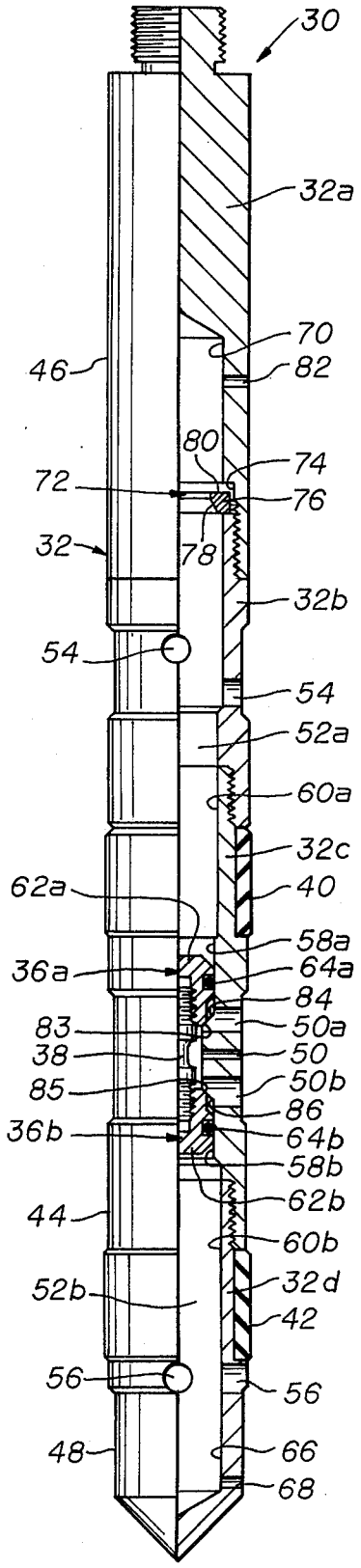
FIG. 2 is a quarter-sectional view of a first embodiment of a circulating valve with the valve closed.
Figure 3:
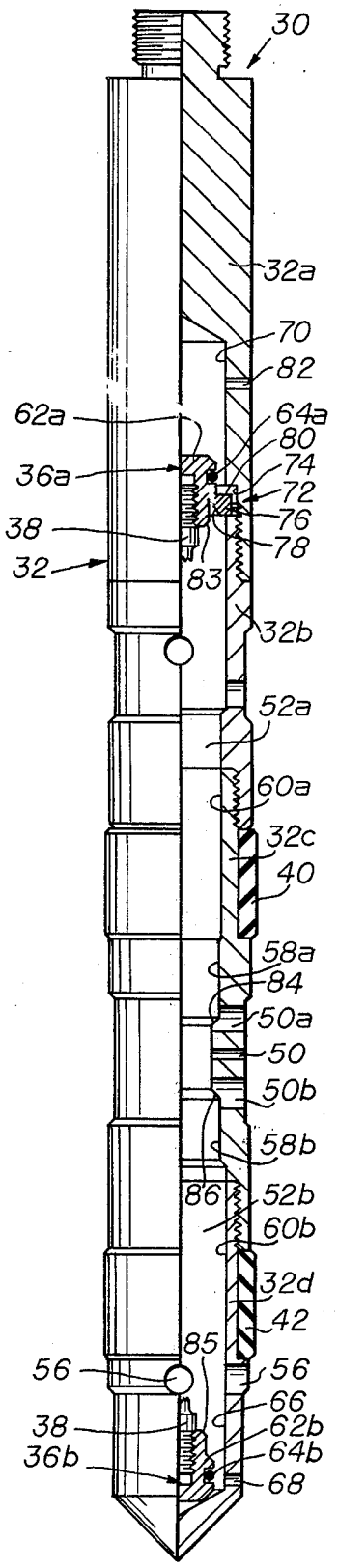
FIG. 3 is a quarter-sectional view of the circulating valve of FIG. 2 with the valve open.
Figure 4:
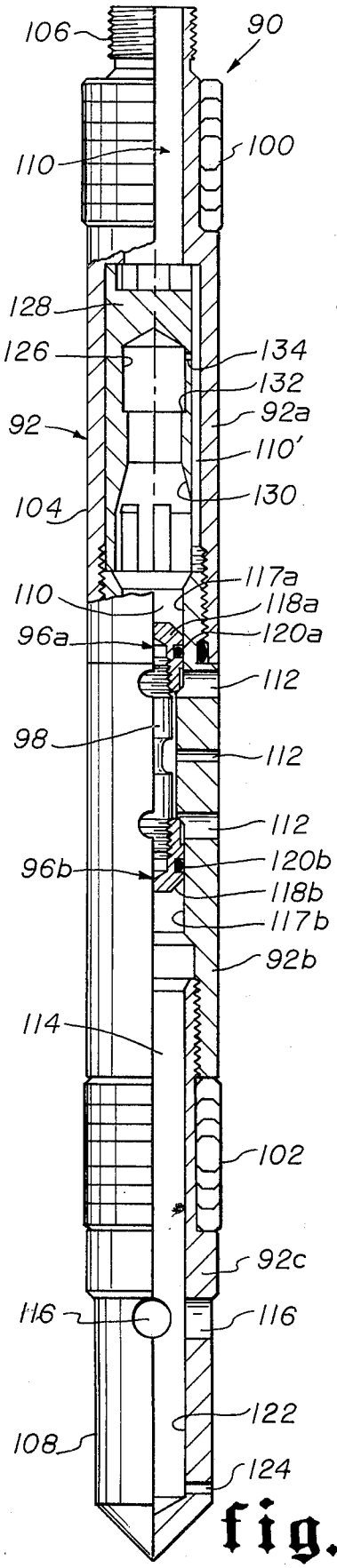
FIG. 4 is in part a quarter-sectional view and in part a view along the lines 5—5 of FIG. 6 and 7 of a second embodiment of a circulating valve with the valve closed.
Figure 5:
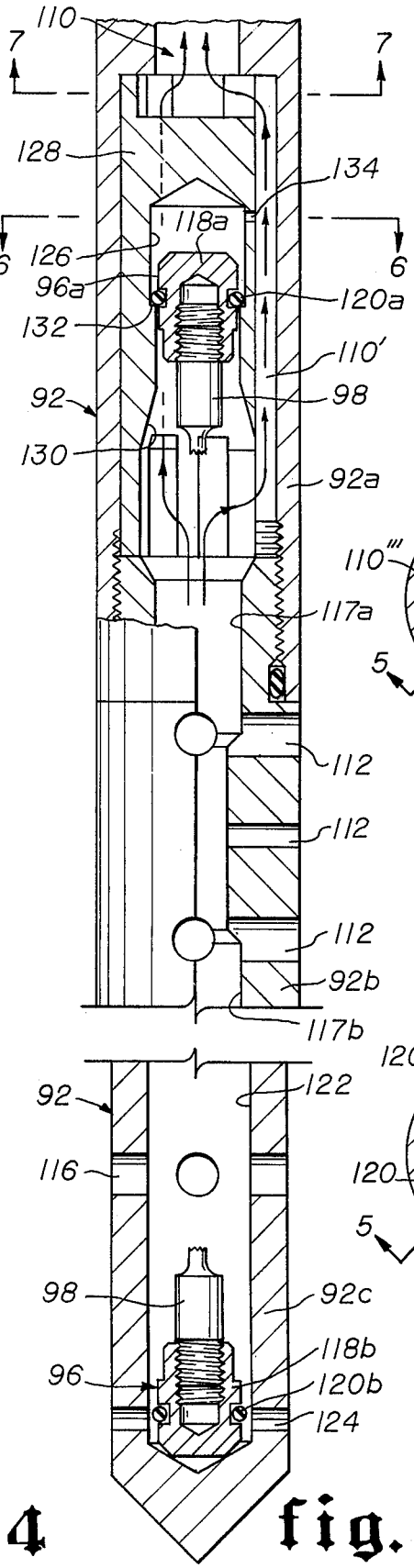
FIG. 5 is a fragmentary view on an enlarged scale of the circulating valve of FIG. 4 with the valve open.

A first embodiment of the circulating valve 30 is shown in greater detail in FIGS. 2 and 3.

The circulating valve, generally indicated at 30, includes a valve housing means 32, flow passage means through valve housing means 32, two valve plug means 36*a* and 36*b* initially closing the flow passage means and frangible draw bar means 38 to releasably maintain both valve plug means 36*a* and 36*b* in their initial position.

Valve housing means, generally indicated at 32, is adapted to be received within the side pocket receptacle 20 of a side pocket mandrel 22. Valve housing means 32 includes interconnected housing sections 32*a*, 32*b*, 32*c*, and 32*d*.

Surrounding valve housing means 32 are two spaced seal means 40 and 42 which are adapted to seal with the side pocket receptacle 20 of side pocket mandrel 22. The spaced seal means 40 and 42 define a seal area 44 and upper 46 and lower 48 end sections of valve housing means 32 to permit controlled flow of fluid through the circulating valve 30 when it is installed within the side pocket receptacle 20.

Flow passage means extends through valve housing means 32 to provide fluid communication between one of the defined seal area 44 and end sections 46 and 48, and the other two of said seal area 44 and end sections 46 and 48. In the illustrated circulating valve 30 fluid flow between the annulus 14 and the bore 16 is provided by a flow passage means including first circulating port means, generally indicated at 50 in valve housing means 32 between spaced seal means 40 and 42 in communication with first port 24 in side pocket mandrel 22 and also including upper 52*a* and lower 52*b* passage means extending through valve housing means 32 communicating between first circulating port means 50 and the upper 46 and lower 48 end section and of valve housing means 32 respectively. Flow passage means provides two flow paths through the circulating valve 30, each flow path providing fluid communication between the annulus 14 and the bore 16. A primary upper flow path extends from a first circulating port means 50*a* through upper passage means 52*a* and out a second circulating port means 54 in the upper end section 46 of valve housing means 32. The flow path from the annulus 14 to the bore 16 for this upper path then extends around the upper end section 46 of the circulating valve 30 and enters the bore 16 at the mouth of the side pocket receptacle 20 or at opening between seal means 40 and latch mechanism 28. A primary lower flow path extends from a first circulating port means 50*b* through a lower passage 52*b* and out third circulating port means 56 in the lower end section 48 of the valve housing means 32. The third circulating port means 56 is in communication with the second port 26 in the side pocket mandrel 22.

Both the upper and lower passage means 52*a* and 52*b* include a reduced diameter, seal bore portion 58*a* and 58*b* respectively in which the upper and lower valve plug means 36*a* and 36*b*, respectively are initially maintained, and an enlarged diameter portion 60*a* and 60*b* to reduce resistance to movement of each valve plug means 36*a* and 36*b* to an out-of-the-way position.

An upper and lower valve plug means 36*a* and 36*b*, respectively, control fluid flow through the flow passage means of the circulating valve 30. In the illustrated circulating valve 30, the valve plug means 36*a* and 36*b* are initially positioned in their respective seal bore portions 58*a* and 58*b* blocking flow through the upper and lower passage means 52*a* and 52*b* between first circulating port means 50 and the upper and lower end sections 46 and 48 of the circulating valve 30. Both valve plug means 36*a* and 36*b* include valve plug body means 62*a* and 62*b*, respectively, and circumferential seal means 64*a* and 64*b* on the respective valve plug body means 62*a* and 62*b*. Both seal means 64*a* and 64*b* are adapted to seal between valve plug of body means 62*a* and 62*b* and the wall of passage means 52 in the seal bore portions 58*a* and 58*b* when valve plug means 36*a* and 36*b* are in their initial position.

The circulating valve 30 is designed to be initially closed and to be opened upon a predetermined pressure differential across both valve plug means 36*a* and 36*b*. Frangible drawbar means 38 releasably maintains valve plug means 36*a* and 36*b* in their initial position closing flow passage means. Upon a predetermined pressure differential across valve plug means 36*a* and 36*b*, which in the illustrated circulating valve 30 is applied from the annulus 14 to the bore 16, frangible drawbar means 38 breaks permitting both valve plug means 36*a* and 36*b* to move to a position opening flow passage means. The size of frangible drawbar means 38 may be varied from one circulating valve assembly 30 to another to provide that the various circulating valve assemblies open at a different desired pressure differential within a range of pressure differentials. For example, different size frangible drawbar means 38 may be designed to break in 500 p.s.i. increments within a range of 1,500 p.s.i. to 3,000 p.s.i. differential pressure.

Once frangible drawbar means 38 breaks both valve plug means 36*a* and 36*b* move to a position permitting any condition of fluid flow between the tubing bore 16 and the annulus 14 and consequently through flow passage means.

Lower pocket means 66 is formed within valve housing means 32 to receive lower valve plug means 36*b* after frangible drawbar means 38 breaks. The illustrated lower pocket means 66 is below passage means 52*b*. Lower valve plug means 36*b* may thus be blown into lower pocket means 66 when frangible drawbar means 38 breaks due to the force of the pressure differential across the lower valve plug means 36*b*. Lower valve plug means will thereafter be maintained in lower pocket means 66 in an out-of-the-way position, out of flow passage means due to the force of gravity. There it will permit any desired condition of flow through passage means.

So that when lower valve plug means 36*b* is blown into lower pocket means 66, its movement is not retarded by fluid that may be within lower pocket means 66, bleed port means 68 is provided in valve housing means 32 communicating between lower pocket means 66 and the exterior of valve housing means 32.

Upper pocket means 70 is also formed within valve housing means 32 to receive upper valve plug means 36*a* after frangible drawbar means 38 breaks. Retainer means, generally indicated at 72, prevent upper valve plug means 36*a* from falling back down into a position blocking flow through upper passage means 52*a* once it has entered upper pocket means 70.

The illustrated upper pocket means 70 is above the flow passage means and opens into passage means 52*a*. Upper valve plug means 36*a* may thus be blown into upper pocket means 70 when frangible drawbar means 38 breaks due to the force of the pressure differential across upper valve plug means 36*a*.

Retainer means, generally indicated at 72, permits upper valve plug means 36*a* to enter upper pocket means 70 but prevents it from falling back down into passage means 52*a*. One preferred and illustrated retainer means 72 comprises an annular recess 74 in which is disposed an expandable and contractible retainer ring means 76. Recess means 74 is at the lower end of upper pocket means 70. Retainer ring means 76 has a downward facing annular chamfered surface 78 to permit upper valve plug means 36*a* to move upwardly past said retainer ring means into the upper pocket means 70 by expanding retainer ring means 76 outwardly into the annulus recess 74. Once upper valve plug means 36*a* has entered upper pocket means 70, retainer ring means 76 contracts and has an upward facing stop shoulder 80 to prevent upper valve plug means 36*a* from dropping out of the upper pocket means 70 (see FIG. 3).

With upper valve plug means 36*a* retained in upper pocket means 70 by retainer means 72 it will thereafter be in an out-of-the-way position out of the flow passage means and will thereafter permit any desired condition of flow through the flow passage means.

So that when upper valve plug means 36*a* is blown into upper pocket means 70 its movement is not retarded by fluid that may be within upper pocket means 70, bleed port means 82 is provided in valve housing means 32 communicating between upper pocket means 70 and the exterior of valve housing means 32.

The illustrated construction of circulating valve 30 simplifies its assembly and the replacement of parts after use.

To assemble the circulating valve 30, circumferential seal means 64 are positioned around each of the valve plug body means 62. One of the valve plug body means 62 is connected to frangible drawbar means 38 as by a threaded connection. Frangible drawbar means 38 with the attached valve plug body means 62 is then inserted within the valve housing section 32*c*. Then the other valve plug body means 62 is also connected to frangible drawbar means 38, as by another threaded connection. The connections are made up until a shoulder 83 of the upper valve plug means 36*a* engages a seat 84 and a shoulder 85 of the lower valve plug means 36*b* also engages a shoulder 86. Care should be taken not to prestress frangible drawbar means 38 as this would cause it to break at an undesired, lower pressure differential. Both valve plug means 36*a* and 36*b* are now releasably maintained within their seal bore portions 58*a* and 58*b* and will seal off both upper and lower passage means 52*a* and 52*b*. Housing sections 30*a*, 30*b* and 30*d* may now be assembled and connected to housing section 30*c*.

Once the circulating valve 30 has been used, frangible drawbar means 38 is replaced. If flow cutting has worn either seal bore portion 58*a* and 58*b*, valve housing section 30*c* is also replaced so that an effective seal may be obtained between valve plug body means 62 and the wall of the respective seal bore portion 58 when a valve plug means 36 is in its initial position.

In operation, the circulating valve 30 of this invention is used to control flow in a well. Extending through the well would be a casing string 10 and a tubing string 12 defining an annulus 14 therebetween and a bore 16 of the tubing string 12. The circulating valve controls flow between the bore 16 and the annulus 14. The circulating valve could be installed in a side pocket receptacle 20 of a side pocket mandrel 22 utilizing a kickover tool of the type disclosed in U.S. Pat. No. 3,876,001 to Goode, the entire disclosure of which is hereby incorporated by reference.

The circulating valve normally prevents flow between the bore 16 and annulus 14 through the ports 24 and 26 of the side pocket mandrel 22. However, when it is desired to provide circulation between the bore 16 and the annulus 14 through these ports, fluid pressure is exerted down the annulus 14 until a sufficient pressure differential exists across both valve plug means 36*a* and 36*b* from the annulus 14 to the bore 16. When a sufficiently high pressure differential has been obtained, frangible drawbar means 38 breaks. Both valve plug means 36*a* and 36*b* are blown into a position permitting flow between the tubing bore 16 and the annulus 14. FIG. 3 shows upper valve plug means 36*a* received within upper pocket means 70 and retained therein by retainer means 72 so that it is out of flow passage means permitting any condition of flow therethrough. FIG. 3 also shows lower valve plug means 36*b* received within lower pocket means 66 where it is also out of flow passage means permitting any condition of flow therethrough.

Once circulating valve 30 has been opened, any desired condition of flow between a tubing bore 16 and the annulus 14 may be created. For example, the well may be killed by injecting fluid down the annulus 14 through the first circulating port 24 of side pocket mandrel 22. From there one flow path will be established through the first circulating port means 50 of the circulating valve 30, the upper passage means 52*a*, second circulating port means 54, and into the side pocket receptacle 20 where it enters the bore 16. Another flow path will be established through first circulating port means 50, lower passage means 52*b*, third circulating port means 56, and through the second port means 26 into the bore 16. Thereafter, any desired operation may be performed on the well.

Once the desired operation has been performed, the circulating valve 30 is retrieved from the well. A kickover tool of the type disclosed in the aforementioned U.S. Pat. No.3,876,001 may be used to retrieve the circulating valve 30.

In FIGS. 4, 5, 6 and 7 a second embodiment of a circulating valve according to this invention is shown.

The circulating valve, generally indicated at 90, includes valve housing means 92, flow passage means defining two flow paths, two valve plug means 96*a* and 96*b*, and frangible drawbar means 98.

Valve housing means 92 is also adapted to be received within side pocket receptacle 20 and includes interconnected housing sections 92*a*, 92*b*, and 92*c*.

Two spaced seal means 100 and 102 surround valve housing means 92, defining a seal area 104 and an upper 106 and lower 108 end section of the valve housing means 92 to permit controlled flow of fluids through the circulating valve 90 when it is installed within a side pocket receptacle 20.

Flow passage means extends through valve housing means 92 and provides two flow paths, with one upper passage means 110 extending between first circulating port means 112 in the seal area 104 of valve housing means 92 and the upper end section 106 of valve housing means 92 and the other, lower passage means 114 extending between first circulating port means 112 and the lower end section 108 at second circulating port means 116. Both upper and lower passage means 110 and 114 include a reduced diameter, seal bore portion 117*a* and 117*b*, respectively.

An upper and lower valve plug means 96*a* and 96*b*, respectively, control fluid flow through the flow passage means by each controlling flow between first circulating port means 112 and a different end section of the valve 90. Each valve plug means 96*a* and 96*b* includes valve plug body means 118*a* and 118*b* and a circumferential seal 120*a* and 120*b*, respectively.

Frangible drawbar means 98 releasably maintains both valve plug means 96*a* and 96*b* in their initial position closing flow passage means and breaks upon a predetermined pressure differential across both valve plug means 96*a* and 96*b* to permit both valve plug means 96*a* and 96*b* to move to a position opening the flow passage means.

Lower pocket means 122 receives lower valve plug means 96*b* where it will be maintained out of the lower passage means 114 due to the force of gravity permitting any condition of flow. A bleed port 124 permits easy entry of the lower valve plug means 96*b* into the lower pocket means 122.

Upper valve plug means 96*a* is retained out of upper passage means 110 in an upper pocket means 126 in housing means 92.

Figure 6:
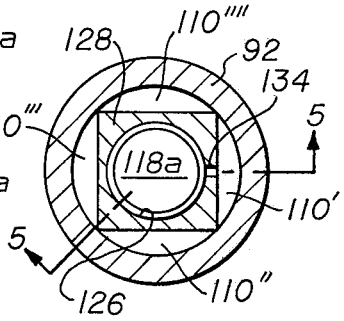
FIG. 6 is a cross-sectional view taken along line 6—6 in FIG. 5.
Figure 7:
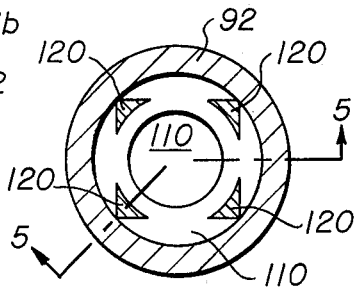
FIG. 7 is a cross-sectional view taken along line 7—7 in FIG. 5.

The illustrated upper plug retainer means includes a plug retainer body means 128 disposed in the passage means 110. Plug retainer body means 128 and upper passage means 110 are adapted to permit flow through upper passage means 110 bypassing plug retainer body means 128. For example, as best seen in FIG. 6, plug retainer body means 128 may be an insert in upper passage means 110 having a square exterior configuration. Upper passage means 110 permits flow bypassing plug retainer body means 128 through the bore passages 110', 110'', 110''', and 110'''' left open between the square plug retainer body means 128 and the cylindrical housing means 92.

Upper pocket means 126 is formed within plug retainer body means 128 and opens into upper passage means 110. Upper pocket means 126 receives and retains upper valve plug means 96*a* after frangible drawbar means 98 breaks.

Upper valve plug means 96*a* is guided into upper pocket means 126 by a downward facing annular tapered surface 130. Once upper valve plug means 96*a* has entered upper pocket means 128, it is retained therein by an upward facing stop shoulder 132 above the annular tapered surface 130. Expandable and contractible means on upper valve plug means 96*a* permits it to enter upper pocket means 126 by contracting and once there expands to engage the shoulder 132 and thereby prevent upper valve plug means 96*a* from falling out of the upper pocket means 126. The preferred expandable and contractible means on upper valve plug means 96*a* is provided by circumferential seal 120*a*. Thus in addition to being sized so that seal 120*a* provides a seal between valve plug body means 118*a* and the wall of seal bore 117*a*, seal 120*a* is also sized so that it is contractible by tapered surface 130 to permit upper valve plug means 96*a* to enter upper pocket means 126 and once the valve plug means 96*a* is in upper pocket means 126, seal 120*a* is expandable to engage stop shoulder 132 to prevent upper valve plug means 96*a* from falling out of upper pocket means 126.

To facilitate ease of entry of upper valve plug means 96*a* into upper pocket means 126 a bleed port 134 is provided communicating between upper pocket means 126 and upper passage means 110. Additionally, fluid flowing in passage means 110 around the retainer body means 128 creates a lower pressure effect through bleed port 134 to maintain the upper valve plug means 96*a* within the upper pocket means 126 so that flowing fluids do not drive upper valve plug means 96*a* back into passage means 110.

The assembly and operation of the second embodiment of the circulating valve 90 are similar to the assembly and operation of the first embodiment of the circulating valve 30.

If desired only an upper passage means may be provided through valve housing means which would communicate between the seal area and the upper end section. Then the upper valve plug would be releasably maintained in an initial position blocking flow through the passage means by frangible drawbar means. Upon the application of a preselected pressure differential across upper valve plug means, frangible drawbar means would break and upper valve plug means would be blown into upper pocket means within valve housing means. There upper valve plug means would be retained, preferably out of the flow path through passage means, permitting any condition of flow through the circulating valve.

From the foregoing it can be seen that the objects of this invention have been obtained. A circulating valve for use in a well has been provided which permits twice the normal flow rate through the valve. An upper and lower valve plug control flow through the valve and when the valve is opened the upper valve plug is retained in a position where it is prevented from falling back into the flow path. Once the circulating valve is opened, any condition of fluid flow through the valve may be provided.

The foregoing disclosure and description of the invention are illustrative and explanatory thereof and various changes in the size, shape, and materials, as well as in the details of the illustrated construction may be made within the scope of the appended claims without departing from the spirit of the invention.

What is claimed is:

1. A circulating valve for use in a well comprising:
valve housing means;
two spaced seal means around said valve housing means defining a seal area and an upper and lower end section of said valve housing means;
circulating port means in said valve housing means between said spaced seal means;
passage means extending through said valve housing means communicating between said circulating port means and said upper end section;
valve plug means initially maintained in said passage means blocking flow through said passage means;
frangible drawbar means releasably maintaining said valve plug means in said initial position;
upper pocket means in said valve housing means in which said valve plug means is received after said frangible drawbar means breaks; and
retainer means to retain said valve plug means in said upper pocket means.

2. A circulating valve for use in a well comprising:
valve housing means;

two spaced seal means around said valve housing means defining a seal area and an upper and lower end section of said spaced seal means;

passage means extending through said valve housing means communicating between said circulating port means and the upper end sections;

valve plug means initially maintained in said passage means blocking flow through said passage means;

frangible drawbar means releasably maintaining said valve plug means in said initial position;

upper pocket means in said housing means out of the flow path through said passage means in which said valve plug means is received after said frangible drawbar means breaks; and retainer means to retain said valve plug means in said upper pocket.

3. A circulating valve for use in a well comprising:

valve housing means;

two spaced seal means around said valve housing means defining a seal area and two end sections of said valve housing means;

circulating port means in said valve housing means between said spaced seal means;

passage means extending through said valve housing means communicating between said circulating port means and each of said end sections;

two valve plug means initially maintained in said passage means, each blocking flow between said circulating port means and a different one of said end sections;

frangible draw bar means releasably maintaining said valve plug means in said initial position;

lower pocket means in said valve housing means in which one of said valve plug means is received after said frangible drawbar means breaks;

upper pocket means in said valve housing means in which the other of said valve plug means is received after said frangible draw bar means breaks; and retainer means to retain said other valve plug means in said upper pocket means.

4. A circulating valve for use in a well comprising:

valve housing means;

two spaced seal means around said valve housing means defining a seal area and two end sections of said valve housing means;

circulating port means in said valve housing means between said spaced seal means;

passage means extending through said valve housing means communicating between said circulating port means and each of said end sections;

two valve plug means initially maintaining in said passage means, each blocking flow between said circulating port means and a different one of said end sections;

frangible drawbar means releasably maintaining said valve plug means in said initial position;

lower pocket means in said valve housing means in which one of said valve plug means is received after said frangible drawbar means breaks;

upper pocket means in said housing means out of the flow path through said passage means in which the other of said valve plug means is received after said frangible drawbar means breaks; and retainer means to retain said other valve plug means in said upper pocket means.

5. A circulating valve for use in a side pocket mandrel of a well comprising:

valve housing means;

two spaced seal means around said valve housing means adapted to seal with the side pocket receptacle of a side pocket mandrel defining a seal area and two end sections of said valve housing means;

circulating port means in said valve housing means between said spaced seal means;

passage means extending through said valve housing means communicating between said circulating port and each of said end sections;

two valve plug means initially maintained in said passage means, each blocking flow between said circulating port means and a different one of said end sections;

frangible drawbar means releasably maintaining said valve plug means in said initial position;

lower pocket means in said valve housing means opening into said passage means in which one of said valve plug means is received after said frangible drawbar means breaks;

upper pocket means in said valve housing means opening into said passage means in which the other of said valve plug means is received after said frangible drawbar means breaks;

expandable and contractible retainer ring means disposed in the lower end of said upper pocket means having a downward facing annular chamfered surface to permit said other valve plug means to move upward past said retainer ring means into said upper pocket means and also having an upward facing stop shoulder to prevent said other valve plug means from dropping out of said upper pocket means.

6. A circulating valve for use in a side pocket mandrel of a well comprising:

valve housing means;

two spaced seal means around said valve housing means adapted to seal with the side pocket receptacle of a side pocket mandrel defining a seal area and two end sections of said valve housing means;

circulating port means in said valve housing means between said spaced seal means;

passage means extending through said valve housing means communicating between said circulating port means and each of said end sections;

two valve plug means initially maintained in said passage means, each blocking flow between said circulating port means and a different one of said end sections;

frangible drawbar means releasably maintaining said valve plug means in said initial position;

lower pocket means in said valve housing means opening into said passage means in which one of said valve plug means is received after said frangible drawbar means breaks;

upper pocket means in said valve housing means out of the flow path through said passage means opening into said passage means in which the other of said valve plug means is received after said frangible drawbar breaks;

expandable and contractible retainer ring means disposed in the lower end of said upper pocket means having a downward facing annular chamfered surface to permit said other valve plug means to move upward past said retainer ring means out into said upper pocket means and also having an upward facing stop shoulder to prevent said other valve plug means from dropping out of said upper pocket means.

7. The circulating valve of claim 6 including:

bleed port means in said valve housing means communicating between said upper pocket means and the exterior of said valve housing means.

8. A circulating valve for use in a side pocket mandrel of a well comprising:

valve housing means;

two spaced seal means around said valve housing means adapted to seal with the side pocket receptacle of a side pocket mandrel defining a seal area and two end sections of said valve housing means;

circulating port means in said valve housing means between said spaced seal means;

passage means extending through said valve housing means communicating between said circulating port means and each of said end sections;

two valve plug means initially maintained in said passage means, each blocking flow between said circulating port means and a different one of said end sections;

frangible drawbar means releasably maintaining said valve plug means in said initial position;

lower pocket means in said valve housing means opening into said passage means in which one of said valve plug means is received after said frangible drawbar means breaks;

upper pocket means in said valve housing means opening into said passage means in which the other of said valve plug means is received after said frangible drawbar breaks;

recess means in said upper pocket means; and expandable and contractible retainer ring means disposed in said recess means, said retainer ring means having a downward facing annular chamfered surface to permit said other valve plug means to expand past said retainer ring means out into said recess means, and also having an upward facing stop shoulder to prevent said other valve plug means from dropping out of said upper pocket means.

9. The circulating valve of claim 8 including:

bleed port means in said valve housing means communicating between said upper pocket means and the exterior of said valve housing means.

10. A circulating valve for use in a side pocket mandrel of a well comprising:

valve housing means;

two spaced seal means around said valve housing means adapted to seal with the side pocket receptacle of a side pocket mandrel defining a seal area and two end sections of said valve housing means;

circulating port means in said valve housing means between said spaced seal means;

passage means extending through said valve housing means communicating between said circulating port means and each of said end sections;

two valve plug means initially maintained in said passage means, each blocking flow between said circulating port means and a different one of said end sections;

frangible drawbar means releasably maintaining said valve plug means in said initial position;

lower pocket means in said valve housing means opening into said passage means in which one of said valve plug means is received after said frangible drawbar means breaks;

upper pocket means in said valve housing means opening into said passage means in which the other of said valve plug means is received after said frangible drawbar means breaks;

said upper pocket means including:

a downward facing annular tapered surface to guide said other valve plug means into said upper pocket means, and an upward facing shoulder above said annular tapered surface; and said other valve plug means including:

contractible and expandable means permitting said other valve plug means to enter said upper pocket means and adapted to engage said shoulder once said valve plug means enters said upper pocket means to prevent said valve plug means from falling out of said upper pocket means.

11. The circulating valve of claim 10 including bleed port means in said plug retainer body means communicating between said upper pocket means and said passage means.

12. A circulating valve for use in a side pocket mandrel of a well comprising:

valve housing means;

two spaced seal means around said valve housing means adapted to seal with the side pocket receptacle of a side pocket mandrel defining a seal area and two end sections of said valve housing means;

circulating port means in said valve housing means between said spaced seal means;

passage means extending through said valve housing means communicating between said circulating port means and each of said end sections;

two valve plug means initially maintained in said passage means, each blocking flow between said circulating port means and a different one of said end sections;

frangible drawbar means releasably maintaining said valve plug means in said initial position;

lower pocket means in said valve housing means opening into said passage means in which one of said valve plug means is received after said frangible drawbar means breaks;

upper plug retainer means incuding:

plug retainer body means disposed in said passage means above said initial position of said valve plug means with said plug retainer body means and said passage means adapted to permit flow through said passage means bypassing said plug retainer body means, upper pocket means formed within said plug retainer body means opening into said passage means in which the other of said valve plug means is received after said frangible drawbar means breaks, a downward facing annular tapered surface to guide said other valve plug means into said upper pocket means, and an upward facing shoulder above said annular tapered surface; and said other valve plug means including:

contractible and expandable means permitting said other valve plug means to enter said upper pocket means and adapted to engage said shoulder once said valve plug means enters said upper pocket means to prevent said valve plug means from falling out of said upper pocket means.

13. The circulating valve of claim 12 including:

bleed port means in said plug retainer body means communicating between said upper pocket means and said passage means.

14. A circulating valve for use in a well comprising:

valve housing means;

two spaced seal means around said valve housing means defining a seal area and an upper and lower end section of said valve housing means;

circulating port means in said valve housing means between said spaced seal means;

passage means extending through said valve housing means communicating between said circulating port means and said upper end section;

upper valve plug means including valve plug body means and circumferential seal means initially maintained in said passage means;

frangible drawbar means releasably maintaining said valve plug means in said initial position; and upper pocket means in said valve housing means in which said upper valve plug means is received after said frangible drawbar means breaks;

wherein said circumferential seal means performs the dual functions of sealing between said valve plug body means and said passage means when said upper valve plug means is in said initial position and of retaining said upper valve plug means in said upper pocket means.

15. A circulating valve for use in a well comprising:

valve housing means;

two spaced seal means around said valve housing means defining a seal area and an upper and lower end section of said valve housing means;

circulating port means in said valve housing means between said spaced seal means;

passage means extending through said valve housing means communicating between said circulating port means and said upper end section;

upper valve plug means including valve plug body means and circumferential seal means initially maintained in said passage means;

frangible drawbar means releasably maintaining said valve plug means in said initial position; and upper pocket means in said valve housing means out of the flow path through said passage means in which said upper valve plug means is received after said frangible drawbar means breaks;

wherein said circumferential seal means performs the dual functions of sealing between said valve plug body means and said passage means when said upper valve plug means is in said initial position and of retaining said upper valve plug means in said upper pocket means.

16. A circulating valve for use in a well comprising:

valve housing means;

two spaced seal means around said valve housing means defining a seal area and two end sections of said valve housing means;

circulating port means in said valve housing means between said spaced seal means;

passage means extending through said valve housing means communicating between said circulating port means and each of said end sections;

upper and lower valve plug means initially maintained in said passage means;

said upper valve plug means including:

valve plug body means, and circumferential seal means;

frangible drawbar means releasably maintaining said upper and lower valve plug means in said initial position;

lower pocket means in said valve housing means in which said lower valve plug means is received after said frangible drawbar means breaks;

upper pocket means in said valve housing means in which said upper valve plug means is received after said frangible drawbar means breaks;

wherein said circumferential seal means of said upper valve plug means performs the dual functions of sealing between said upper valve plug body means and said passage means when said upper valve plug means is in said initial position and of retaining said upper valve plug means in said upper pocket means.

17. A circulating valve for use in a well comprising:

valve housing means;

two spaced seal means around said valve housing means defining a seal area and two end sections of said valve housing means;

circulating port means in said valve housing means between said spaced seal means;

passage means extending through said valve housing means communicating between said circulating port means and each of said end sections;

upper and lower valve plug means initially maintained in said passage means, each blocking flow between said circulating port means in a different one of said end sections;

said upper valve plug means including:

valve plug body means, and circumferential seal means;

frangible drawbar means releasably maintaining said upper and lower valve plug means in said initial position;

lower pocket means in said valve housing means in which said lower valve plug means is received after said frangible drawbar means breaks;

upper pocket means in said valve housing means out of the flow path through said passage means in which the upper valve plug means is received after said frangible drawbar means breaks; and wherein said circumferential seal means for said upper valve plug means performs the dual functions of sealing between said valve plug body means and said passage means when said upper valve plug means is in said initial position and of retaining said upper valve plug means in said upper pocket means.

18. A circulating valve for use in a side pocket mandrel of a well comprising:

valve housing means;

two spaced seal means around said valve housing means adapted to seal with the side pocket receptacle of a side pocket mandrel defining a seal area and two end sections of said valve housing means;

circulating port means in said valve housing means between said spaced seal means;

passage means extending through said valve housing means communicating between said circulating port means and each of said end sections;

upper and lower valve plug means initially maintained in said passage means, each blocking flow between said circulating port means and a different one of said end sections;

said upper valve plug means including:

valve plug body means, and circumferential seal means on said body plug means;
frangible drawbar means releasably maintaining said upper and lower valve plug means in said initial position;
lower pocket means in said valve housing means opening into said passage means in which said lower valve plug means is received after said frangible drawbar means breaks;
upper pocket means in said valve housing means opening into said passage means in which said upper valve plug means is received after said frangible drawbar means breaks;
said upper pocket means including:
a downward facing annular tapered surface to guide said upper valve plug means into said upper pocket means, and
an upward facing shoulder above said annular tapered surface; and
wherein said circumferential seal means performs the dual functions of sealing between said valve plug body means and said passage means when said upper valve plug means is in said initial position and of engaging said upward facing shoulder to retain said upper valve plug means in said upper pocket means.

19. A circulating valve for use in a side pocket mandrel of a well comprising:
valve housing means;
two spaced seal means around said valve housing means adapted to seal with the side pocket receptacle of a side pocket mandrel defining a seal area and two end sections of said valve housing means;
circulating port means in said valve housing means between said spaced seal means;
passage means extending through said valve housing means communicating between said circulating port means and each of said end sections;
upper and lower valve plug means initially maintained in said passage means, each blocking flow between said circulating port means in a different one of said end sections;
said upper valve plug means including:
valve plug body means, and
circumferential seal means around said valve plug body means;
frangible drawbar means releasably maintains said upper and lower valve plug means in said initial position;
lower pocket means in said valve housing means opening into said passage means in which said lower valve plug means is received after said frangible drawbar means breaks;
upper plug retainer means including:
plug retainer body means disposed in said passage means above said initial position of said upper valve plug means with said plug retainer body means and said passage means adapted to permit flow through said passage means bypassing said retainer plug body means;
upper pocket means formed within said plug retainer body means opening into said passage means in which said upper valve plug means is received after said frangible drawbar means breaks;
a downward facing annular tapered surface to guide said upper valve plug means into said upper pocket means, and
an upward facing shoulder above said annular tapered surface; and
wherein said circumferential seal means of said upper valve plug means performs the dual functions of sealing between said valve plug body means and said passage means when said upper valve plug means is in said initial position and of engaging said upward facing shoulder to retain said upper valve plug means in said upper pocket means.

20. A circulating valve for use in a well comprising:
valve housing means;
two spaced seal means around said valve housing means defining a seal area and an upper and lower end section of said valve housing means;
circulating port means in said valve housing means between said spaced seal means;
passage means extending through said valve housing means communicating between said circulating port means and each of said end sections providing two flow paths through said valve housing means, one of which extends from said seal area to said upper end section and the other of which extends from said seal area to said lower end section;
upper and lower valve plug means each of which is movable between an initial position blocking flow through said passage means and a second position permitting flow through said passage means; and
frangible drawbar means to releasably maintain each of said valve plug means in said initial position.

* * * * *